US010151113B2

(12) United States Patent
Agee

(10) Patent No.: US 10,151,113 B2
(45) Date of Patent: Dec. 11, 2018

(54) REBAR CENTRALIZER FOR USE IN A DRILLED SHAFT/BORE HOLE

(71) Applicant: Pieresearch1, LP, Arlington, TX (US)

(72) Inventor: Stanley D. Agee, Arlington, TX (US)

(73) Assignee: Pieresearch1, LP, Arlington, TX (US)

( * ) Notice: Subject to any disclaimer, the term of this patent is extended or adjusted under 35 U.S.C. 154(b) by 0 days.

(21) Appl. No.: 15/458,775

(22) Filed: Mar. 14, 2017

(65) Prior Publication Data

US 2017/0268235 A1 Sep. 21, 2017

Related U.S. Application Data

(60) Provisional application No. 62/308,737, filed on Mar. 15, 2016.

(51) Int. Cl.
*E21B 17/10* (2006.01)
*E04C 5/20* (2006.01)

(52) U.S. Cl.
CPC ..... *E04C 5/203* (2013.01); *E21B 17/105* (2013.01); *E21B 17/10* (2013.01); *E21B 17/1078* (2013.01)

(58) Field of Classification Search
CPC ..... E21B 17/1042; E21B 17/105; E21B 17/1078; E21B 17/1057; E21B 17/10; E04C 5/203; E04C 5/163; E04C 5/162; E04C 5/161; E04C 5/16
See application file for complete search history.

(56) References Cited

U.S. PATENT DOCUMENTS 4,077,470 A * 3/1978 Dane ..... E21B 17/1028 166/241.7
4,088,186 A * 5/1978 Callihan ..... E21B 17/1028 166/173
4,909,322 A * 3/1990 Patterson ..... E21B 17/1028 166/241.7
5,542,785 A 8/1996 Cloud
6,257,792 B1 * 7/2001 Read, Jr. ..... E21B 17/046 166/242.6
6,299,386 B1 10/2001 Byrne et al.
6,367,556 B1 * 4/2002 Moore ..... E02D 5/805 166/241.1
6,457,519 B1 10/2002 Buytaert
6,637,511 B2 * 10/2003 Linaker ..... E21B 17/1028 166/213
6,679,325 B2 * 1/2004 Buytaert ..... E21B 17/1028 166/174
6,997,254 B2 2/2006 Jenner
D662,952 S 7/2012 Kirk et al.
(Continued)

OTHER PUBLICATIONS

"C&M Duraflex PVC Centralizers," The Industry Standard Developed by C&M Mfg. Co., 2010, 6 pages.
(Continued)

*Primary Examiner* — Phi D A
(74) *Attorney, Agent, or Firm* — Slater Matsil, LLP

(57) ABSTRACT

A system for centering a reinforcing member within a drilled shaft/bore hole includes a first cage member and a second cage member. The first cage member is operable to surround a first half of the reinforcing member. The second cage member is operable to surround a second half of the reinforcing member. The second cage member is operably connected to the first cage member, and the first and second cage members have identical shapes.

22 Claims, 11 Drawing Sheets

(56) References Cited

U.S. PATENT DOCUMENTS

| | | | | |
|---|---|---|---|---|
| 8,245,777 | B2 | 8/2012 | Garner | |
| 8,262,308 | B2 * | 9/2012 | Peng | F16B 5/0635 285/39 |
| D671,960 | S | 12/2012 | Kirk et al. | |
| 8,919,437 | B2 | 12/2014 | MacLeod | |
| 9,249,575 | B2 | 2/2016 | Hutchison et al. | |
| 9,249,633 | B1 * | 2/2016 | Arizmendi | E21B 17/1078 |
| 9,771,763 | B2 * | 9/2017 | McDaniel | E21B 17/1028 |
| 2015/0284958 | A1 | 10/2015 | Hutchison et al. | |

OTHER PUBLICATIONS

Liu, "Casing Centralizer Series—1: Types of Centralizers," Pegasus Vertex, Inc., Jan. 13, 2015, 3 pages.
"Rigid-Bar Centralizer," Weatherford International, Cementing Products, 2012, 2 pages.

* cited by examiner

REBAR CENTRALIZER FOR USE IN A DRILLED SHAFT/BORE HOLE

This patent application claims the benefit of U.S. provisional application No. 62/308,737, filed Mar. 15, 2016, which is incorporated herein by reference in its entirety.

TECHNICAL FIELD

The present invention relates to a rebar centralizer, for example, for use in a drilled shaft/bore hole to centralize a single rebar member in the drilled shaft/bore hole.

BACKGROUND

Earth retention systems provide shoring for excavation support and reinforcement for the permanent stabilization of deep cuts and slopes. Soil nailing supports excavations and provides slope stability control. Deep foundations transfer building loads to a subsurface layer of the earth beneath the surface.

Soil nailing is a construction technique that inserts reinforcing bars (rebar), which may be high-strength steel bar or steel strand tendon, into a drilled shaft/bore hole to provide permanent or temporary support to unstable or potentially unstable slopes. Soil nailing may be used, for example, to stabilize slopes and landslides, provide earth retention for excavations, and repair existing retaining walls. A type of deep foundation is created by drilling a hole/shaft into the earth to bedrock and filling the hole/shaft with a single rod of rebar. The drilled shaft/bore hole is then filled with grout or concrete to affix the rebar in place.

Without proper alignment of the rebar within the drilled shaft/bore hole, the rebar cannot perform the function for which it was designed or may become compromised over time due to corrosion and/or misalignment. Because the rebar is surrounded by grout or concrete, the position of the rebar within the drilled shaft/bore hole cannot be inspected after the grout has been placed within the drilled shaft/bore hole.

U.S. Pat. No. 6,299,386 discloses a method and apparatus for shoring a wall. The method includes inserting retaining elements substantially vertically and side by side into an earthen mass to shore the face of an excavation. Soil nails are then inserted into the excavation plane, at the approximate midpoint between a pair of adjacent retaining elements. The soil nails include a threaded core element that receives at least two centralizers. An exposed tip portion of each soil nail attaches to a wale, which is a substantially horizontal element that contacts a retaining element on both sides of each soil nail. The concrete reinforcement bars can then receive a concrete fill to form a solid wale structure. Face stability is achieved with the pre-installed retaining elements, which with the wales provide complete facing support.

A rebar centralizer is disclosed in U.S. Patent Publ. No. 2015/0284958. In this document, a rebar centralizer system comprises a first ring and a second ring configured to be positioned in an angular relationship with each other. The first and second rings are configured to at least partially intersect so as to present at least one interior corner in which a section of rebar can be secured.

U.S. Pat. No. 5,542,785 discloses a rebar cage wheel spacer centralizer system for drilled shafts. In this document, a spacer is mounted on a lateral rebar tie of a reinforcement cage of a poured concrete foundation support. The spacer includes a pair of interlocking wheel members which lock the wheel members together in a mated interlocked relationship rotatably mounted about a lateral tie of the reinforcement cage to form the spacer. Each spacer is formed from a pair of substantially identical substantially semi-cylindrically shaped interlocking wheel members which, when assembled, form rotatable wheel assemblies. As the reinforcement cage is inserted into an excavated shaft, the outer side wall of the spacer engages and rolls along the side wall thereof. The engagement of the side wall of the excavated shaft by the spacers centers the reinforcement cage within the excavated shaft and maintains the reinforcement cage in its centered position as the excavated shaft is filled with concrete.

SUMMARY

In accordance with an embodiment of the present invention, a rebar centralizer can be used in a drilled shaft/bore hole to centralize a single rebar member in the drilled shaft/bore hole. One general aspect includes a cage member for use in a system for centering a reinforcing member within a drilled shaft/bore hole. The cage member includes a first neck portion, a second neck portion spaced from the first neck portion along a center axis, a first collar adjacent the first neck portion, a second collar adjacent the second neck portion, and a plurality of arms extending from the first collar to the second collar. The first and second neck portions, the first and second collars and the arms are formed as a single integral member. The first and second collars are formed symmetrically so that the cage member can be interlocked with a substantially identical cage member so as to form a centralizing cage.

Another general aspect includes a system for centering a reinforcing member within a drilled shaft/bore hole. The system includes a first centralizing member having a first end and an opposing second end. Each of the first and second ends of the first centralizing member has a protrusion extending inwardly toward the reinforcing member. The first centralizing member is configured to surround a first half of the reinforcing member and the protrusion is configured to engage the first half of the reinforcing member. A second centralizing member also has a first end and a second opposing end. Each of the first and second ends of the second centralizing member have a protrusion extending inwardly toward the reinforcing member. The second centralizing member is configured to surround a second half of the reinforcing member and the protrusion is configured to engage the second half of the reinforcing member. The second centralizing member is substantially identical to the first centralizing member.

Another general aspect includes a system for centering a reinforcing member within a drilled shaft/bore hole. The system includes a first cage member operable to surround a first half of the reinforcing member. The reinforcing member includes a substantially straight rod. A second cage member is operable to surround a second half of the reinforcing member and is operably connected to the first cage member. The first and second cage members have substantially identical shapes. Each of the first and second cage members each includes a first neck portion, a second neck portion spaced from the first neck portion along a center axis, a first semi-annular shoulder adjacent the first neck portion, a second semi-annular shoulder adjacent the second neck portion, and an arm extending from the first neck portion to the second neck portion. The first and second neck portions, the first and second semi-annular shoulders and the arm are a single integral member.

Yet another general aspect includes a method for centering a reinforcing bar within a drilled shaft/bore hole. A centralizing cage is assembled by attaching a first centralizing cage member with an identical second centralizing cage member. The first and second centralizing cage members both include a first neck portion, a second neck portion spaced from the first neck portion along a center axis, a first semi-annular shoulder adjacent the first neck portion, a second semi-annular shoulder adjacent the second neck portion, and a plurality of arms extending from the first neck portion to the second neck portion. The first and second neck portions, the first and second semi-annular shoulders and the arms are formed as a single integral member. The centralizing cage is secured to the reinforcing bar at a first position along the reinforcing bar. The reinforcing bar is inserted into the drilled shaft/bore hole. The centralizing cage keeps the reinforcing bar spaced from walls of the drilled shaft/bore hole. The drilled shaft/bore hole is filled with a fixant to fix the centralizing cage and the reinforcing bar in place within the drilled shaft/bore hole.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF ILLUSTRATIVE EMBODIMENTS

Figure 1:
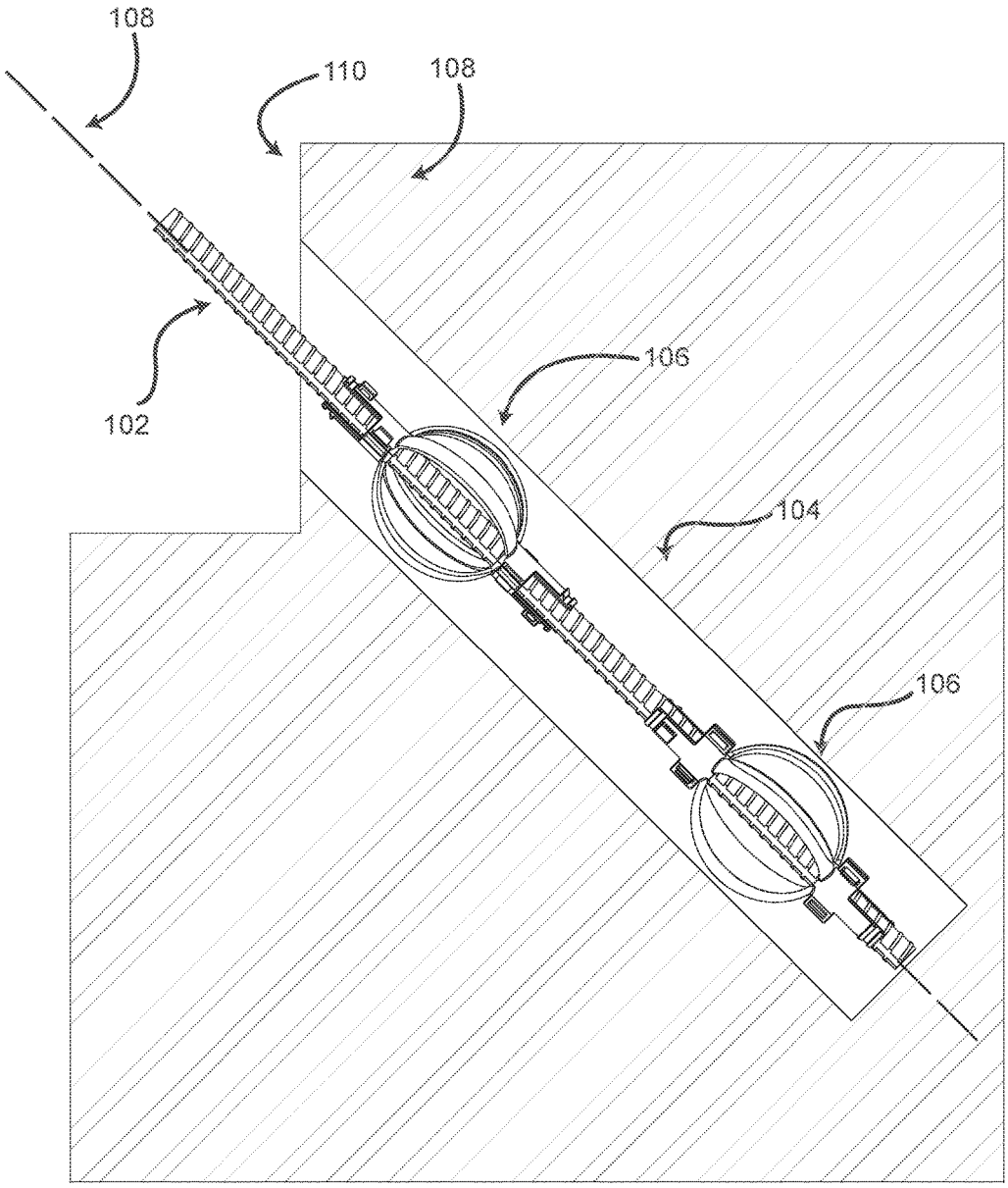
FIG. 1 illustrates a system for stabilizing the ground in accordance with some embodiments.

The following disclosure provides many different embodiments, or examples, for implementing different features of the invention. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Referring to FIG. 1, an illustrative embodiment of a system 100 for centering a reinforcing member 102 inside a drilled shaft/bore hole 104 is presented. In some embodiments, the system 100 is used in conjunction with a construction technique known as soil nailing that is used to stabilize the surrounding ground. In other embodiments, the system can be used with a wellbore or any other hole or shaft.

As will be discussed in further detail below, a cage centralizer 106 is designed to keep the tendon/bar 102 centered in the bore/drill hole 104 to allow for minimum grout/concrete coverage without impeding flow of the grout within the bore/drill hole 104 and around the tendon 102. The cage centralizer 106 can be made from a durable non-corrosive plastic and includes two identical halves that are easily snapped together without additional fasteners.

This centralizer can accommodate single bar, multi-bar/strand anchors, encapsulated (DCP) anchors, and steel or plastic pipe applications. Particular embodiments envisioned are for soil nails, rocks/soil anchors, micro-piles, and auger-cast piles with single tension bars.

Figure 2:
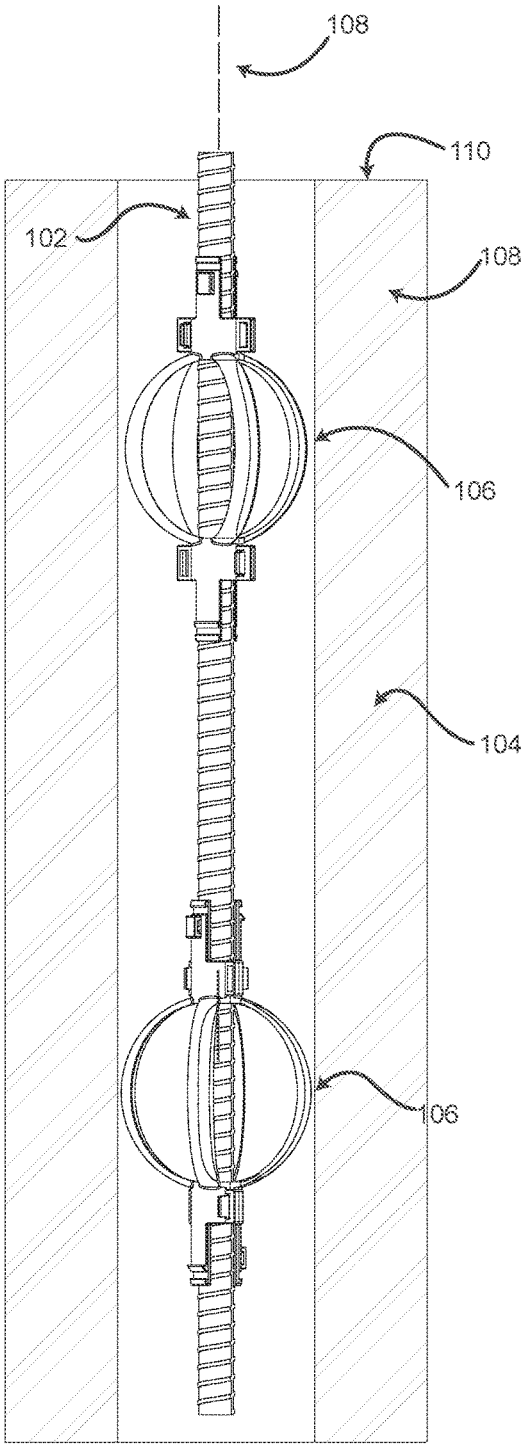
FIG. 2 illustrates another system for stabilizing the ground in accordance with some embodiments.

The drilled shaft/bore hole 104 is formed in the ground 108, e.g., soil, earth, dirt. The ground 108 may include a wall 110, where the drilled shaft/bore hole 104 is drilled through the wall 110. In some embodiments, the wall 110 is substantially vertical, as shown in FIG. 2. In other embodiments, the wall 110 may be sloped and may, for example, form an embankment. The drilled shaft/bore hole 104 may be drilled vertically, horizontally, or at an angle. The term drilled/hole shaft refers to any hole or shaft in which is it desired to centralize rebar.

The reinforcing member 102 may be referred to as rebar, e.g., reinforcing steel or reinforcement steel. The member 102, however, is not necessarily made of steel. In some embodiments, the reinforcing member 102 may be high-strength steel bars, steel strand tendons, or the like. As is known, the outer surface of the reinforcing member 102 can be patterned to form a better bond with the concrete that will be injected in the drilled shaft/bore hole 104.

The system 100 includes one or more centralizing cages 106 that are positioned around the reinforcing member 102. The embodiment illustrated in FIGS. 1 and 2 show two centralizing cages 106. In some embodiments, the outer diameter of the centralizing cages 106 is slightly smaller than the diameter of the drilled shaft/bore hole 104. The centralizing cages 106 help to keep the reinforcing member 102 centered within the drilled shaft/bore hole 104. In an aspect, the centralizing cages 106 help to keep the reinforcing member 102 away from walls of the drilled shaft/bore hole 104 preferably positioned substantially along a center axis 109 of the drilled shaft/bore hole 104.

The centralizing cage 106 may be placed on the reinforcing member 102 at various locations on the reinforcing member 102. In one embodiment, a first centralizing cage may be placed at one end of the reinforcing member 102 and a second centralizing cage may be placed at a second, opposing end of the reinforcing member 102. Multiple centralizing cages 106 may be placed along the length of the reinforcing member 102 to help guide the reinforcing member 102 into the drilled shaft/bore hole 104 and keep the reinforcing member 102 centralized and away from the sidewalls of the drilled shaft/bore hole 104. The number of cages 106 will be determined by the application, e.g., the length of the reinforcing member 102.

The centralizing cage 106 can be attached to the reinforcing member 102 in any manner that keeps the centralizing cage 106 in position while the drilled shaft/bore hole 104 is being filled. For example, the centralizing cage 106 can be attached to the reinforcing member 102 using a zip tie, tie wrap (or tie wraps), wire, tape (e.g., duct tape), among other methods. Typically the centralizing cage 106 will be immobilized so that it cannot move up or down the reinforcing member 102 or rotate around the reinforcing member 102.

As noted above, FIG. 2 illustrates an embodiment where the reinforcing member 102 is inserted vertically into the hole/shaft 104. An example of a vertical reinforcement is an auger cast pile. Other examples are also possible.

Figure 3:
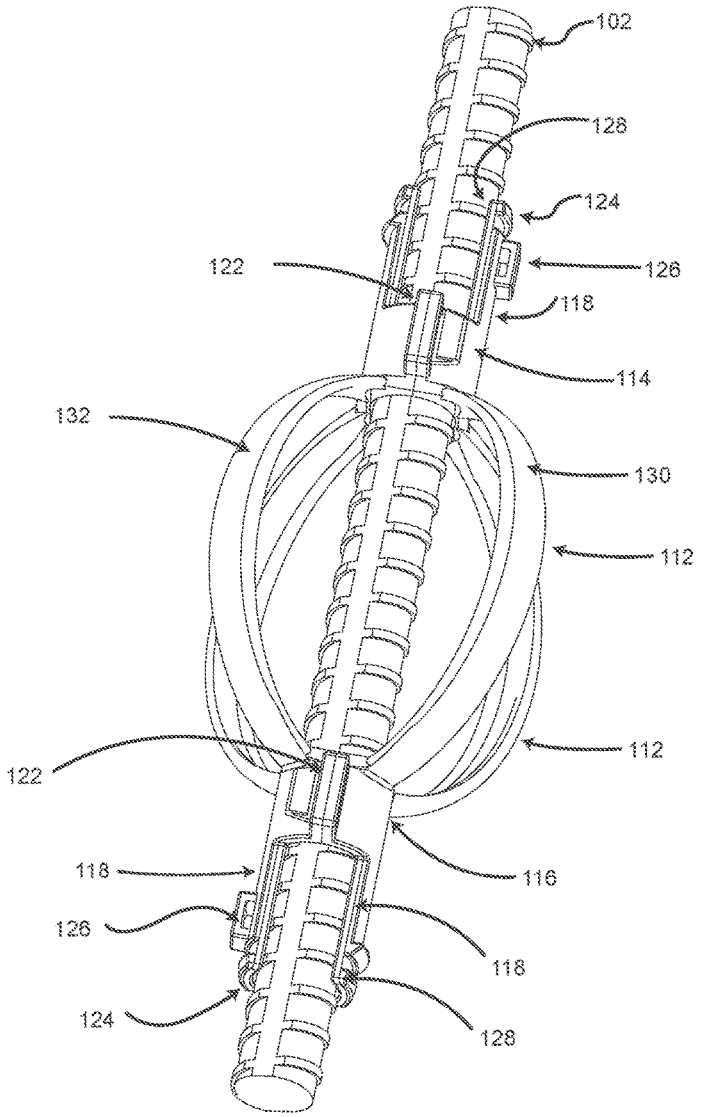
FIG. 3 is a perspective view of a centralizing member surrounding a reinforcing member in accordance with some embodiments.
Figure 4A:
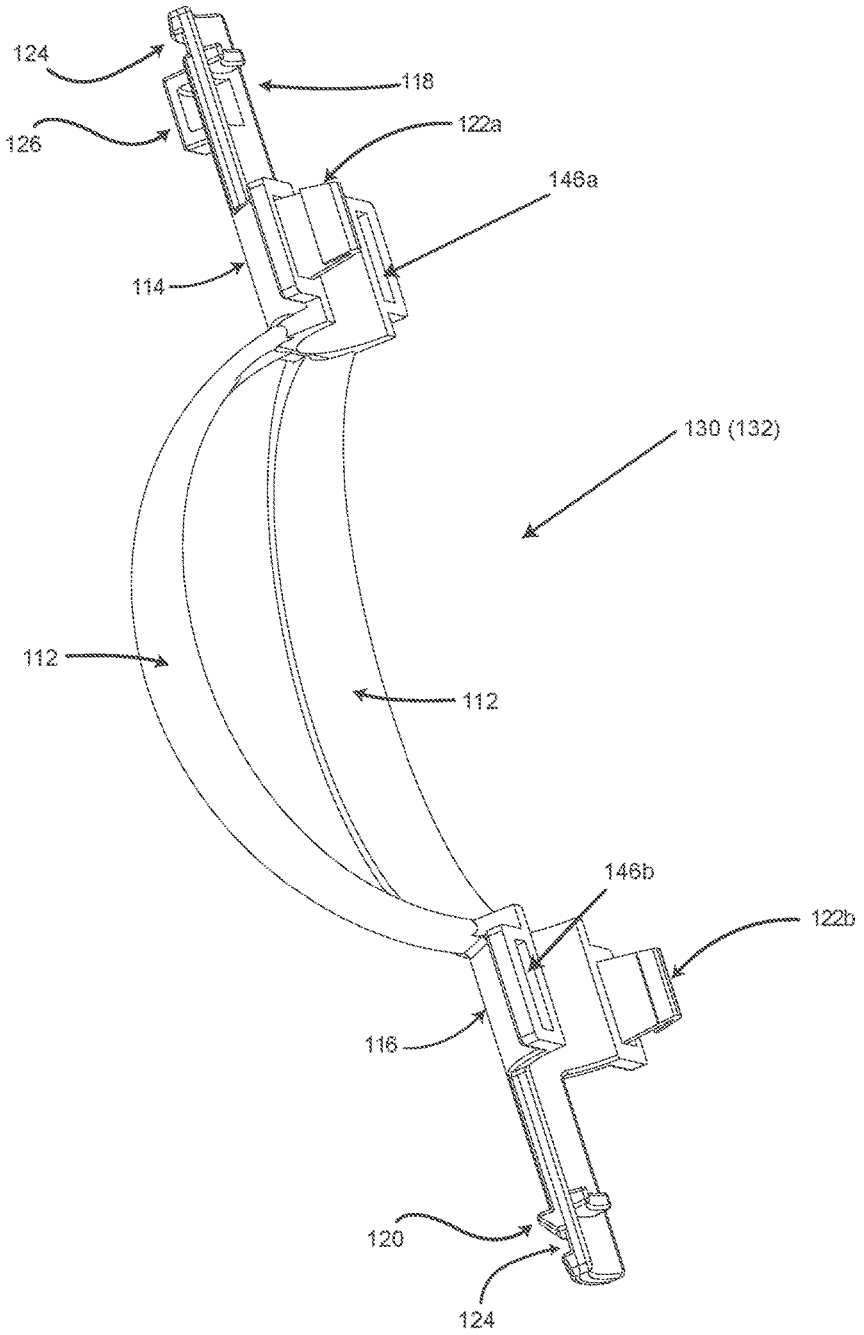
FIGS. 4A-4C, collectively referred to as FIG. 4, illustrates perspective views of a particular embodiment centralizing cage from different viewpoints.
Figure 4B:
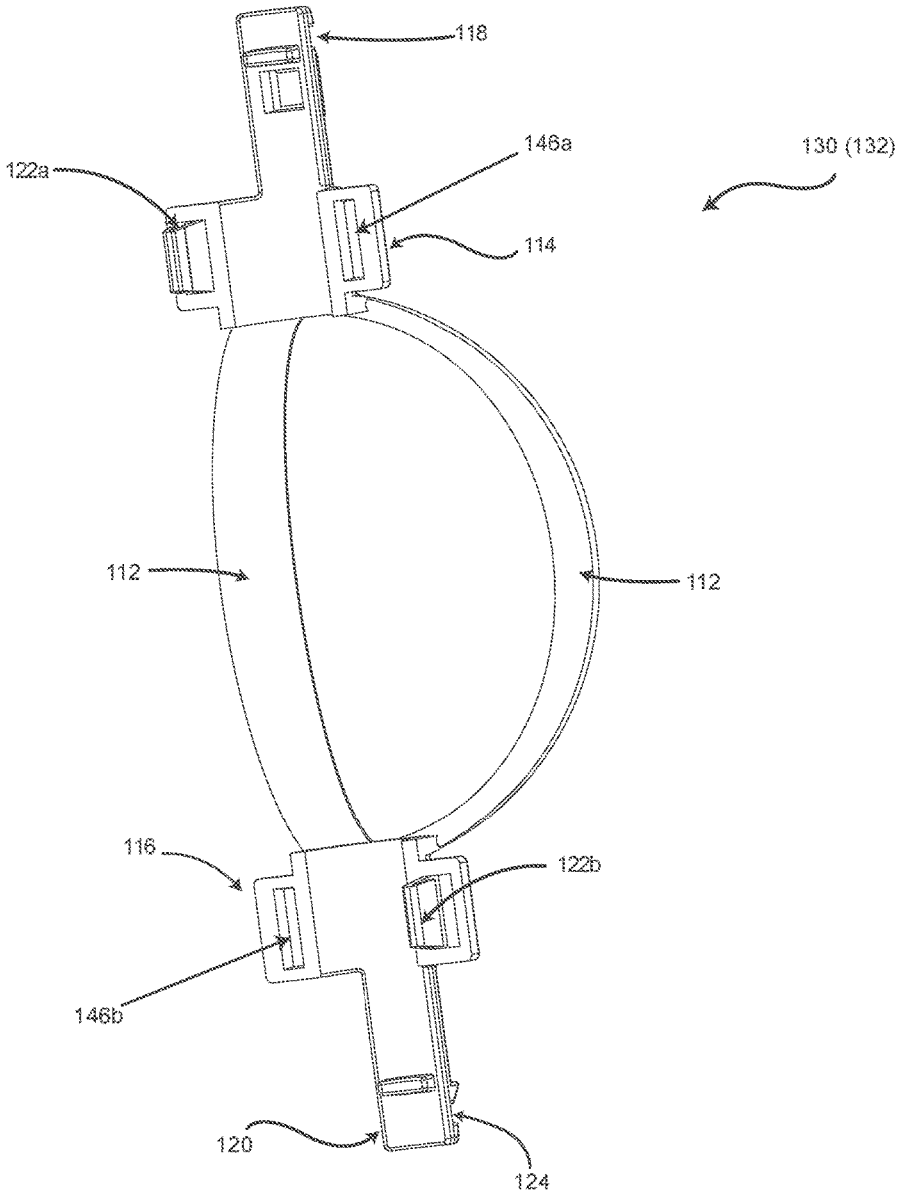
Figure 4C:
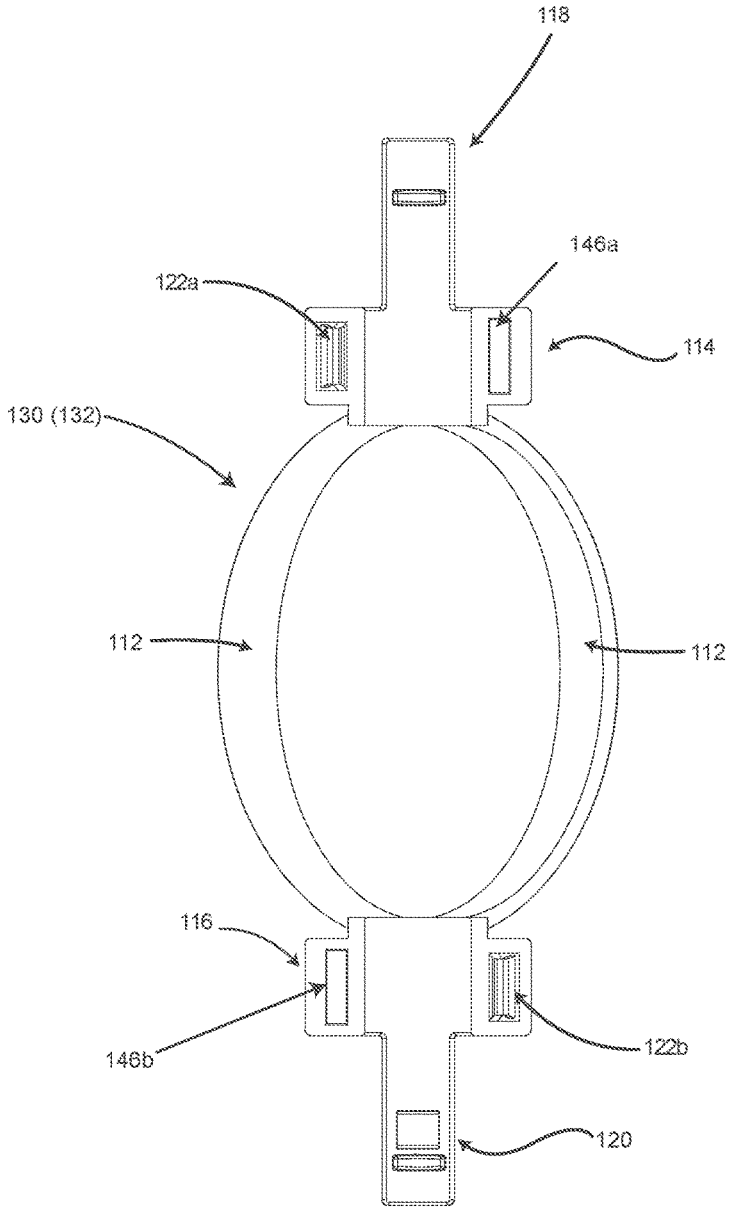

The centralizing cage will now be described with respect to FIG. 3 and FIGS. 4A-4C (collectively "FIG. 4"). FIG. 3 shows a close-up, perspective view of a centralizing cage 106 surrounding the reinforcing member 102. The centralizing cage 106 is formed from two substantially identical pieces 130 and 132, referred to as cage members or halves. FIG. 4 three views of the cage members 130 (or 132).

The two pieces 130 and 132 surround the reinforcing member 102 when assembled as shown in FIG. 3. In its simplest configuration, the centralizing cage 106 includes a first neck 118, a first collar 114, a plurality of arms 112, a second collar 116, and a second neck 120. The first and second collars 114, 116 form first and second semi-annular shoulders when connected together. The first and second neck portions 118 and 120, the first and second collars 114 and 116 and the arms 112 are formed as a single integral member.

Each of the cage members 130 (132) will now be described with respect to FIGS. 4A-4C, in conjunction with FIG. 3. Since the cage members are substantially identical, the illustrated cage member can be either a first half 130 or a second half 132. This feature provides advantages in procurement and in the field since the cage members are interchangeable. Also, because the cage is formed in two pieces, transport and storage are simplified.

The first and second collars 114, 116 both include a set of flanges to assist with attachment. In this example, the first collar 114 includes a locking member that is formed from a tab 122*a* and a corresponding slot 146*a*. Similarly, second collar 116 includes a locking member that is formed from a tab 122*b* and a corresponding slot 146*b*. The locking members are provided to fasten the two halves of the centralizing cage 106 together. The first and second collars are formed symmetrically so that the cage member can be interlocked with a substantially identical cage member so as to form a centralizing cage 106.

The first collar includes a first tab and a first slot and the second collar includes a second tab and a second slot. The first tab is configured to join with a second slot of the substantially identical cage member; the first slot is configured to receive a second tab of the substantially identical cage member; the second tab is configured to join with a first slot of the substantially identical cage member; and the second slot is configured to receive a first tab of the substantially identical cage member. In this example, the slots and tabs 122 and 146 are arranged on opposite sides so that when to cage members 130 and 132 are brought together, the tab 122*a* will fit within the slot 146*b* and similarly the tab 122*b* will fit within the slot 146*a*.

In some embodiments, the identical halves 130, 132 are removably connected to each other. In alternative embodiments, the identical halves 130, 132 are permanently connected to each other. In a preferred embodiment, the cage member is designed to be permanently interlocked with the substantially identical cage member so as to form the centralizing cage.

Each cage member 130 (132) includes a plurality of arms extending between the collars 114 and 116. In the illustrated example, each cage member includes two arms 112 so that the assembled cage will include four arms 112. Each of the arms extends away from a central axis of the centralizing cage 106. In the typical embodiment, the structure is built so that the central access will be aligned with a central axis of the reinforcing member 102, which is in turn aligned with the center axis 109 of the drilled shaft/bore hole 104. The arms will extend equal distances away from the common central axis.

As illustrated in the figures, the arms 112 can have a curved shape with the peak being at a point central between the first collar 114 and the second collar 116. In other examples, the arms 112 can include segments that are joined at various angles. The arms 112 are spaced equally along the circumference of a circle with a center point that intersects the central axis. It is noted, however, that these preferred configurations are not a requirement. In the typical implementation, the reinforcing member 102 will be centered within the drilled shaft/bore hole 104. Other embodiments are also envisioned.

A first neck 118 extends from the first collar 114 and a second neck 120 extends from the second collar 116. The first and second necks 118, 120 are shaped such that the inner surface of the first and second neck 118, 120 fit around the outer diameter of the reinforcing member 102. Since the reinforcing member is typically a cylindrical bar, the first and second necks 118, 120 have a substantially curved or annular shape such that the inner surface of the first and second neck 118, 120 curves at least partially around the outer diameter of the reinforcing member 102. Other shapes could also be used.

Both the first neck and the second neck 118, 120 can be designed to facilitate a tie or other fastener that is used to attach the assembled centralizing cage 106 two a reinforcing member 102. In the illustrated example, the first and second neck 118, 120 each have a channel or groove 124 formed therein on an outer surface. The second neck 120, in some embodiments, includes an enclosure 126 with an aperture formed therein.

Extending from the inner surface of the first and second neck 118, 120 is a protrusion 128. The protrusion 128 is operable to engage the outer surface of the reinforcing member 102 to help prevent slippage of the centralizing cage 106 distally along the length of the reinforcing member 102.

Figure 5:
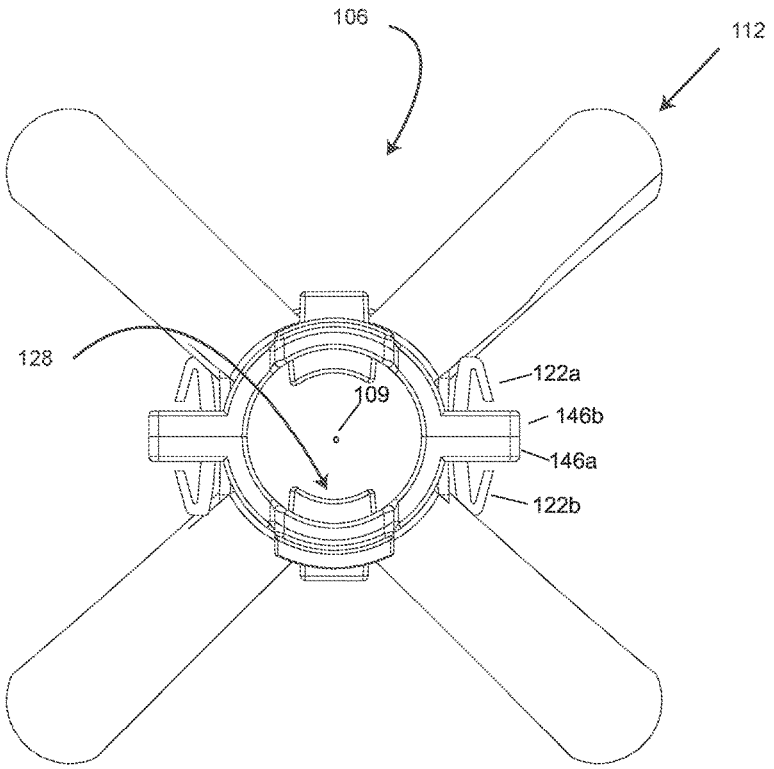
FIG. 5 is a top view of the centralizing member of FIG. 4 in accordance with some embodiments.

FIG. 5 shows a view of an assembled centralizing cage 106 as viewed along the central axis 109 of the cage and, in the typical case, of the reinforcing bar 102 and the drilled shaft/bore hole 104. As shown here, the arms extending radially away from the central axis 109. The four arms in this example are equally spaced 90° apart from each other.

This view also shows the tabs 122 interconnected with the slots 146. As shown, the tab 122 of one of the two halves is interlocked with the slot 146 of the other of the two halves. It is understood that, while they appear to be aligned looking into and out of the page, the two pairs of slots and tabs are actually spaced along the central axis 109. Also pointed out in the figure is the tab 128, which can be used to prevent slippage along the reinforcing member 102.

Figure 6A:
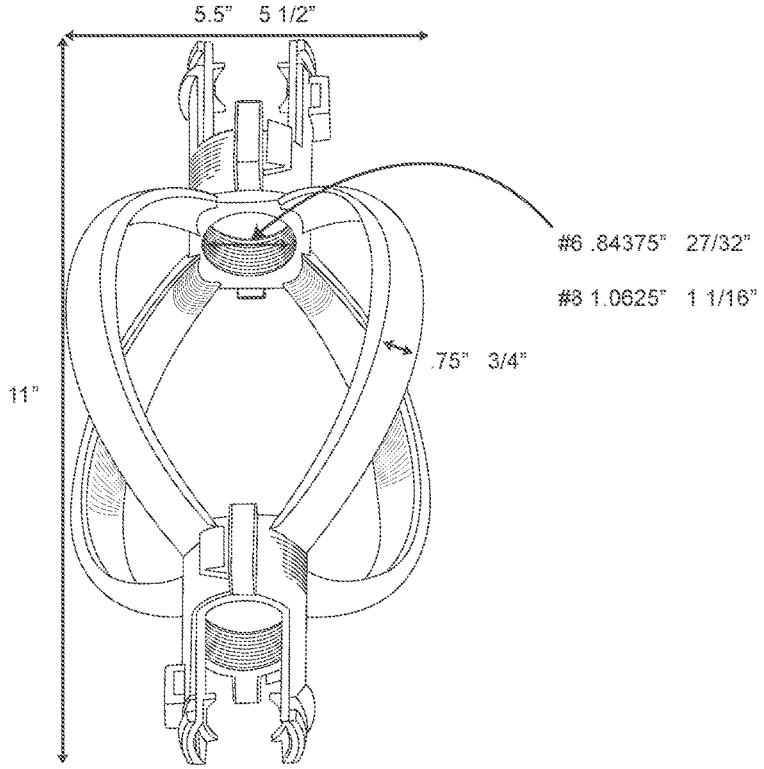
FIGS. 6A-6C, collectively referred to as FIG. 6, shows views of various sized centralizing cages in accordance with some embodiments.
Figure 6B:
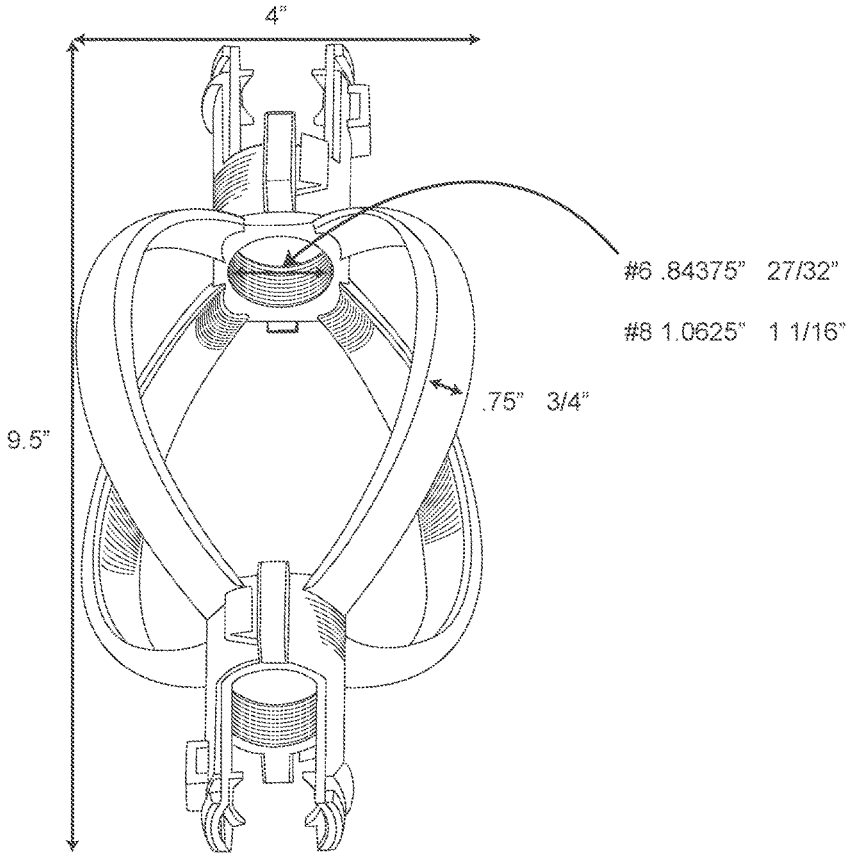
Figure 6C:
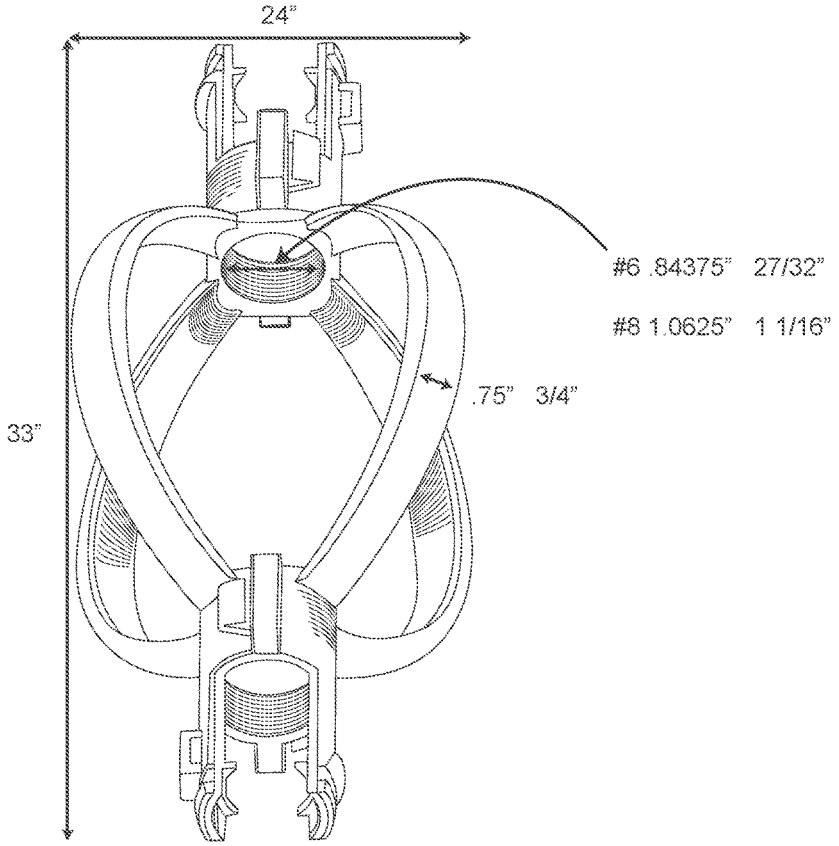

FIGS. 6A-6C are provided to show that the centralizing cage 106 can be formed in any number of dimensions. Three specific examples are provided here.

In the example of FIG. 6A, this particular cage has a length that is twice the width, 11 inches by 5.5 inches in this case. This cage can be used, for example, in a six inch bore hole (or any other drilled shaft/bore hole that is larger than 5.5 inches). The specific dimensions illustrated here can be modified depending upon the design, e.g., could be scaled proportionately.

The centralizing cage 106 of the present invention can be used with various dimensioned rebar. For example, the collar have a diameter of 0.8475 inches to fit around tendon/rebar sizes #5 through #6 or can have a diameter of 1.0625 inches to fit around tendon/rebar sizes #7 through #8.

In general, the centralizing cage 106 can be sized in any dimension, based on the size of the drilled shaft/bore hold and the tendon/rebar. For example, it is envisioned that a centralizing cage 106 can be sized to fit a drilled shaft/bore hole of 4 inches (or even smaller) up to 24 inches or larger. It can be sized to operate with a rebar/tendon from #8 to #24, as examples.

Figure 7:
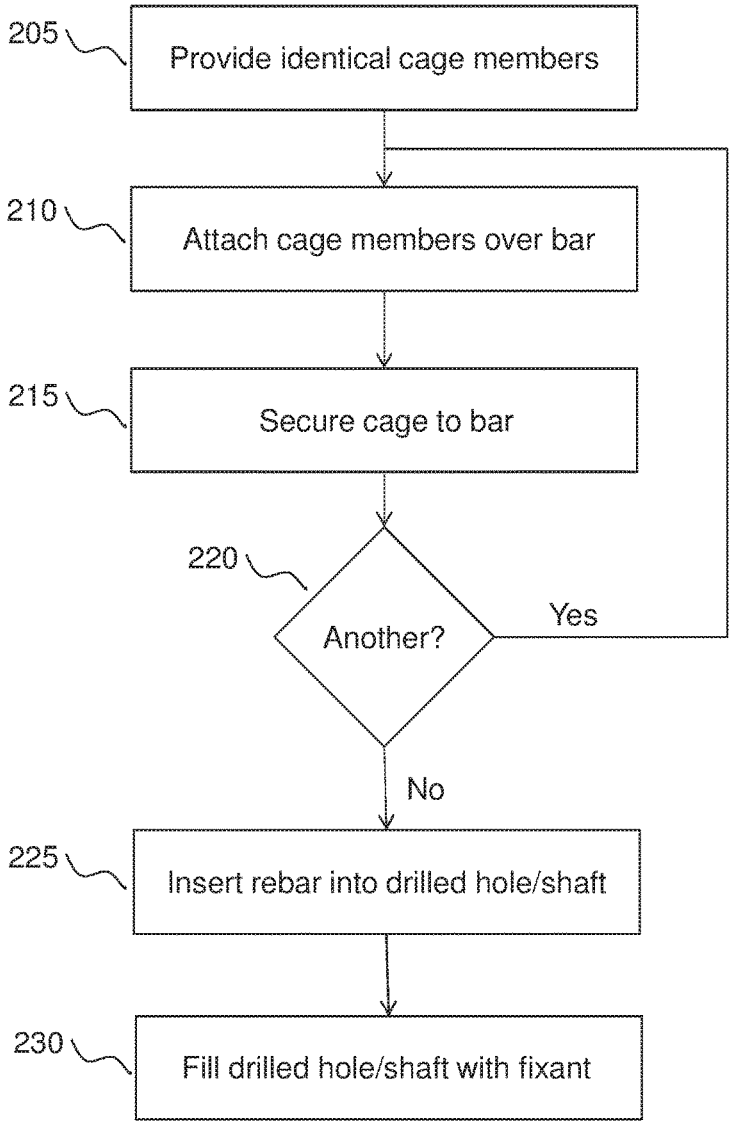
FIG. 7 is a flowchart summarizing steps in utilizing the centralizer.

FIG. 7 provides a flow chart illustrating a method of using the centralizing cage 106. This example provides a method for centering a reinforcing bar 102 within a drilled shaft/bore hole 104. A number of substantially identical cage members are provided as shown in step 205. These members may be as described above. For example, each centralizing cage member includes a first neck portion, a second neck portion spaced from the first neck portion along a center axis, a first semi-annular shoulder adjacent the first neck portion, a second semi-annular shoulder adjacent the second neck portion, and a plurality of arms extending from the first neck portion to the second neck portion. The first and second neck portions, the first and second semi-annular shoulders and the arm can be formed as a single integral member.

The centralizing cage is assembled by attaching a first centralizing cage member with an identical second centralizing cage member as indicated in step 210 of the flowchart. Preferably, the centralizing cage is assembled around the bar, although it is possible to preassemble the cages and then slide onto the bar. As discussed above, the centralizing cage includes protrusions extending toward the reinforcing bar. The centralizing cage can be deformed until the protrusions engage an outer surface of the reinforcing bar.

FIGS. 8 and 9 of U.S. Patent App. Pub. No. 2017/0268235 ('the '235 publication) provide photographs that show the assembly process being performed in the field.

Referring to step 215, the centralizing cage secured to the reinforcing bar at a first position along the reinforcing bar. This step can be performed with ties or any other means. Examples of assembled centralizing cages are shown in FIGS. 10, 11A, 11B, 12A, and 12B of the '235 publication. These steps can be repeated for however many centralizing cages are to be used as indicated by step 220.

As an example, the lowest centralizing cage can be installed approximately one foot from the end of the reinforcing bar. Each successive centralizing cage can be placed at intervals of no greater than 10 feet. The upper centralizing cage can be approximately one foot below the grout/concrete surface. FIG. 13 of the '235 publication illustrates a reinforcing bar with several centralizing cages attached thereto.

As indicated by step 225, the reinforcing bar with the attached centralizing cage(s) can then be inserted into the drilled shaft/bore hole. Each centralizing cage keeps the reinforcing bar spaced from walls of the drilled shaft/bore hole. Due to the construction of the centralizing cages, the reinforcing bar is positioned substantially along a center axis of the drilled shaft/bore hole, thus preventing the reinforcing bar from touching sidewalls of the drilled shaft/bore hole.

The drilled shaft/bore hole can then be filled with a fixant to fix the centralizing cage and the reinforcing bar in place within the drilled shaft/bore hole, as indicated by step 230. The fixant can be concrete, grout, mortar or any other material to be used in the particular application. Grout is typically used with soil nails. Bearing plates can then be installed before a final facing is put in place to complete the process.

It should be appreciated that the centralizing cages 106 may be used in any of the following processes: Auger Cast Pile, Auger Cast-in-Place Pile, Auger Grouted Cast in Place Pile (ACIP), Auger Grouted Pile, Auger Pile, Battered Piles, Bored Piles, Caissons, Cast-In-Drilled-Holes Piles/Piers (CIDH), Cast-In-Place Piles/Piers, Cast-In-SITU Piles, Continuous Flight Auger Pile (CFA), Drill Displacement Pile, Drilled Piers, Drilled Shafts, Franki Piles (PIF), Fundex Screw Piles, Ground Anchors, Grouted tiebacks, Inclined Tiebacks, Laterally Loaded Piles, Macropiles, Micropiles, Minipiles, Needle piles, Omega Screw Piles, Pin piles, Rock Anchors, Root piles, Screw Piers, Screw Piles, Soil Nails, Soil Anchors, Soil Tiebacks, Tensile Anchors, Tie Back Anchors, Tie Down Anchors, Tieback Anchors, Tie-back Anchors, Tiebacks, Tiedown Anchors, Under-Reamed Pile or in any application in which a single rebar rod/member needs to be centralized in a drilled shaft/bore hole in any orientation.

As discussed above, embodiments of the invention include a number of advantages. For example, embodiments can include some or all of the following:

- two identical halves
- easy to snap together
- made of durable non-corrosive plastic
- can be attached with zip ties or tie wire
- offset to fit between rebar threads
- keeps single tendon/bar centered within a drill hole
- ideal for soil nail applications
- no nuts or bolts required
- light weight and economical The provisional application from which this patent claims the benefit includes additional figures and an appendix to illustrate further views of the centralizer, first prior to assembly and then with two halves assembled together. The views in that filing are incorporated herein by reference along with the rest of the application.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A cage member for use in a system for centering a reinforcing member within a drilled shaft/bore hole, the reinforcing member extending along a center axis and the cage member being a single member that comprises a plurality portions, the cage member comprising:

a first neck portion having a concave shape relative to the center axis;

a second neck portion having a concave shape relative to the center axis, the second neck portion spaced from the first neck portion in a direction along the center axis;

a first collar portion adjacent the first neck portion;

a second collar portion adjacent the second neck portion, wherein the first and second collar portions are located between the first neck portion and the second neck portion in the direction along the center axis;

a first protrusion adjacent the first neck portion or the first collar portion and extending inwardly toward the center axis, the first protrusion configured to engage the reinforcing member when the cage member is in use;

a second protrusion adjacent the second neck portion or the second collar portion and extending inwardly toward the center axis, the second protrusion configured to engage the reinforcing member when the cage member is in use; and a plurality of separate arm portions extending in the direction along the center axis from the first collar portion to the second collar portion, the separate arm portions being spaced from one another;

wherein the first and second neck portions, the first and second collar portions, the first and second protrusions and the separate arm portions of the cage member are portions of the single member; and wherein the first and second collar portions are formed symmetrically so that the cage member can be interlocked with a substantially identical cage member so as to form a centralizing cage.

2. The cage member of claim 1, wherein the first collar portion includes a first tab and a first slot and the second collar portion includes a second tab and a second slot, wherein the first tab is configured to join with a second slot of the substantially identical cage member, the first slot is configured to receive a second tab of the substantially identical cage member, the second tab is configured to join with a first slot of the substantially identical cage member, and the second slot is configured to receive a first tab of the substantially identical cage member.

3. The cage member of claim 2, wherein the first tab and the second slot are arranged on the left side of a line extending through the center axis of the cage member and wherein the second tab and the first slot are arranged on the right side of the line extending through the central axis of the cage member.

4. The cage member of claim 1, wherein a first channel is formed in an outer surface of the first neck portion and a second channel is formed in an outer surface of the second neck portion.

5. The cage member of claim 4, wherein the first protrusion extends from an inner surface of the first neck portion and the second protrusion extends from an inner surface of the second neck portion.

6. The cage member of claim 1, further comprising a first set of flanges extending from the first collar portion and a second set of flanges extending from the second collar portion.

7. The cage member of claim 1, wherein the plurality of arm portions curve outward from the center axis.

8. The cage member of claim 1, wherein the arm portions are equally spaced along a circumference of a circle extending through a central axis of an assembled cage that includes the cage member.

9. The cage member of claim 1, wherein the first protrusion extends from an inner surface of the first neck portion and the second protrusion extends from an inner surface of the second neck portion.

10. The cage member of claim 1, wherein the cage member is designed to be permanently interlocked with the substantially identical cage member so as to form the centralizing cage.

11. A centralizing cage for use in centering a reinforcing member within a drilled shaft/bore hole, the reinforcing member extending along a center axis, the centralizing cage comprising:

a first centralizing member having a first end and an opposing second end, each of the first and second ends of the first centralizing member having a protrusion extending inwardly toward the center axis, wherein the first centralizing member includes a neck having a concave shape relative to the center axis and configured to surround a first half of a diameter of the reinforcing member, and wherein the protrusion is configured to engage the first half of the reinforcing member when the centralizing cage is in use; and a second centralizing member having a first end and a second opposing end, each of the first and second ends of the second centralizing member having a protrusion extending inwardly toward the center axis, wherein the second centralizing member includes a neck having a concave shape relative to the center axis and is configured to surround a second half of the diameter of the reinforcing member, and wherein the protrusion is configured to engage the second half of the reinforcing member when the centralizing cage is in use;

wherein the neck of the first centralizing member and the neck of the second centralizing member are shaped so that the neck of the first centralizing member and the neck of the second centralizing member surround the diameter of the reinforcing member when the first and second centralizing members are attached;

wherein the first centralizing member is a single integral member;

wherein the second centralizing member is a single integral member; and wherein the second centralizing member is substantially identical to the first centralizing member.

12. The centralizing cage of claim 11, wherein the first and second centralizing members are connected.

13. The centralizing cage of claim 11, wherein first and second centralizing members each comprise a plurality of arm portions extending between a first collar portion and a second collar portion, a first neck portion extending from the first collar portion and a second neck portion extending from the second collar portion.

14. The centralizing cage of claim 11, wherein first centralizing member comprises a plurality of arm portions extending between a first collar portion and a second collar portion, a first neck portion extending from the first collar portion and a second neck portion extending from the second collar portion;

wherein the first collar portion includes a first tab and a first slot and the second collar portion includes a second tab and a second slot;

wherein the first tab is configured to join with a second slot of the second centralizing member;

wherein the first slot is configured to receive a second tab of the second centralizing member;

wherein the second tab is configured to join with a first slot of the second centralizing member; and wherein the second slot is configured to receive a first tab of the second centralizing member.

15. The centralizing cage of claim 11, wherein the first centralizing member comprises a plurality of arm portions extending between a first collar portion and a second collar portion, a first neck portion extending from the first collar portion and a second neck portion extending from the second collar portion;

wherein the first collar portion includes a first tab and a first slot and the second collar portion includes a second tab and a second slot;

wherein the first tab is permanently attached with a second slot of the second centralizing member;

wherein the first slot is permanently attached with a second tab of the second centralizing member;

wherein the second tab is permanently attached with a first slot of the second centralizing member; and wherein the second slot is permanently attached with a first tab of the second centralizing member.

16. A method for centering a reinforcing bar within a drilled shaft/bore hole, the method comprising:

assembling a centralizing cage by attaching a first centralizing cage member with an identical second centralizing cage member, wherein the first and second centralizing cage member are formed symmetrically so that the first centralizing member is interlocked with the second centralizing cage member so as to form a centralizing cage;

securing the centralizing cage to the reinforcing bar at a first position along the reinforcing bar;

inserting the reinforcing bar into the drilled shaft/bore hole, wherein the centralizing cage keeps the reinforcing bar spaced from walls of the drilled shaft/bore hole, the reinforcing bar extending along a center axis of the drilled shaft/bore hole; and filling the drilled shaft/bore hole with a fixant to fix the centralizing cage and the reinforcing bar in place within the drilled shaft/bore hole;

wherein the first and second centralizing cage members each comprise:

a first neck portion having a concave shape relative to the center axis;

a second neck portion having a concave shape relative to the center axis, the second neck portion spaced from the first neck portion in a direction along the center axis;

a first collar portion adjacent the first neck portion;

a second collar portion adjacent the second neck portion, wherein the first and second collar portions are formed symmetrically and wherein the first and second collar portions are located between the first neck portion and the second neck portion in the direction along the center axis;

a first protrusion adjacent the first neck portion or the first collar portion and extending inwardly toward the center axis, the first protrusion engaging the reinforcing bar after securing the centralizing cage to the reinforcing bar;

a second protrusion adjacent the second neck portion or the second collar portion and extending inwardly toward the center axis, the second protrusion engaging the reinforcing bar after securing the centralizing cage to the reinforcing bar; and a plurality of separate arm portions extending from the first collar portion to the second collar portion, wherein the separate arm portions are spaced from one another, the first and second neck portions, the first and second collar portions, the first and second protrusions, and the arm portions being formed as a single integral member.

17. The method of claim 16, further comprising:

assembling a second centralizing cage by attaching third and fourth first centralizing cage members that are identical to the first and second centralizing cage members; and positioning the second centralizing cage at a second position on the reinforcing bar, the second position spaced from the first position;

wherein filling the drilled shaft/bore hole comprises filling the drilled shaft/bore hole with a fixant to fix the centralizing cage, the second centralizing cage and the reinforcing bar in place within the drilled shaft/bore hole.

18. The method of claim 17, further comprising positioning a third centralizing cage around a third position on the reinforcing bar, wherein the third position is between the first and second position.

19. The method of claim 16, wherein the reinforcing bar is positioned by the centralizing cage substantially along a center axis of the drilled shaft/bore hole.

20. The method of claim 16, further comprising deforming the centralizing cage until the first and second protrusions engage an outer surface of the reinforcing bar.

21. A centralizing cage system for use in centering a reinforcing member within a drilled shaft/bore hole, the centralizing cage system comprising first and second substantially identical centralizing members;

wherein the first centralizing member is a single integral member;

wherein the second centralizing member is a single integral member;

wherein the first centralizing member has a first end and an opposing second end, each of the first and second ends of the first centralizing member having a protrusion extending inwardly toward a center axis, wherein the first centralizing member is configured to surround a first half of the reinforcing member when the reinforcing member extends along the center axis, and wherein the protrusion is configured to engage the first half of the reinforcing member;

wherein the second centralizing member has a first end and a second opposing end, each of the first and second ends of the second centralizing member having a protrusion extending inwardly toward the center axis, wherein the second centralizing member is configured to surround a second half of the reinforcing member when the reinforcing member extends along the center axis, and wherein the protrusion is configured to engage the second half of the reinforcing member;

wherein first centralizing member comprises a plurality of arm portions extending between a first collar portion and a second collar portion, a first neck portion extending from the first collar portion and a second neck portion extending from the second collar portion;

wherein second centralizing member comprises a plurality of arm portions extending between a first collar portion and a second collar portion, a first neck portion extending from the first collar portion and a second neck portion extending from the second collar portion;

wherein the first collar portion of the first centralizing member includes a first tab and a first slot and wherein the second collar portion of the first centralizing member includes a second tab and a second slot;

wherein the first collar portion of the second centralizing member includes a first tab and a first slot and wherein the second collar portion of the second centralizing member includes a second tab and a second slot;

wherein the first tab of the first centralizing member is configured to join with the second slot of the second centralizing member;

wherein the first slot of the first centralizing member is configured to receive the second tab of the second centralizing member;

wherein the second tab of the first centralizing member is configured to join with the first slot of the second centralizing member; and wherein the second slot of the first centralizing member is configured to receive the first tab of the second centralizing member.

22. The centralizing cage system of claim 21, wherein the first tab of the first centralizing member is permanently attached with the second slot of the second centralizing member, wherein the first slot of the first centralizing member is permanently attached with the second tab of the second centralizing member, wherein the second tab of the first centralizing member is permanently attached with the first slot of the second centralizing member, and wherein the second slot of the first centralizing member is permanently attached with the first tab of the second centralizing member.

* * * * *